US006491650B2

(12) United States Patent
Huang

(10) Patent No.: US 6,491,650 B2
(45) Date of Patent: Dec. 10, 2002

(54) LEG EXERCISING EQUIPMENT

(76) Inventor: Chin-Hsin Huang, No. 19, Alley 27, Lane 194, Chang-Shuei Road, Chang-Hwa City (TW)

( * ) Notice: Subject to any disclaimer, the term of this patent is extended or adjusted under 35 U.S.C. 154(b) by 0 days.

(21) Appl. No.: 09/750,078

(22) Filed: Dec. 29, 2000

(65) Prior Publication Data

US 2002/0087104 A1 Jul. 4, 2002

(51) Int. Cl.[7] ..... A61H 1/00
(52) U.S. Cl. ..... 601/35; 601/34; 601/27
(58) Field of Search ..... 601/27, 31, 34, 601/46, 85, 86, 88–91, 97–98, 100–101, 104; 5/101, 108, 109

(56) References Cited

U.S. PATENT DOCUMENTS 2,529,721 A * 11/1950 Baruch ..... 5/109
4,258,446 A * 3/1981 McAllister ..... 5/109
4,949,712 A * 8/1990 Torii ..... 128/25
5,328,443 A * 7/1994 Lee ..... 601/92
5,381,572 A * 1/1995 Park ..... 5/600
5,468,215 A * 11/1995 Park ..... 601/123
5,695,451 A * 12/1997 Kawakami ..... 601/84
6,056,706 A * 5/2000 Hung ..... 601/89

* cited by examiner

*Primary Examiner*—Justine R. Yu
(74) *Attorney, Agent, or Firm*—Rosenberg, Klein & Lee

(57) ABSTRACT

A leg exercising equipment is disclosed. It mainly comprises a base, a driving system, and a lower leg supporting frame for exercising the legs and lower body of a user. The driving system includes a driving device, a rotary element, a link, a guiding element and a guiding frame. So, it can create a unique substantially 8-shaped smooth reciprocated moving path to overcome the sharp-return problem of the conventional one. This invention's exercise is very smooth, comfortable, and effective. Also, it contains both the horizontal and vertical movements for exercise. And, the starting section and the ending section are added to provide a better exercising effect.

5 Claims, 6 Drawing Sheets

LEG EXERCISING EQUIPMENT

BACKGROUND OF INVENTION

1. Field of the Invention

The present invention is related to a leg exercising equipment. Particularly, it is an exercising equipment for swinging legs to create an 8-shaped smooth reciprocated moving path and to contain both the horizontal and vertical exercising movements.

2. Description of the Prior Art

As shown in FIGS. 7 and 8, it is a typical conventional horizontal moving apparatus for leg exercise. It comprises a base 91, a driving system 80 and a supporting frame 92. In which, this driving system 80 contains two horizontal fixed rods 81, a sliding block 82 that can horizontally slide on these two fixed rods 81, a disk 83, and a driving motor (not shown). The disk 83 extends out an offset bar 831. Because a vertical slot 821 is disposed on the sliding block 82, the offset bar 831 of the disk 83 can insert in. Once the disk 83 is rotated, the offset rod 831 will force the sliding block 82 to move back and forth horizontally.

However, the conventional "horizontal-typed" moving apparatus has the following disadvantages:

(1) The "sharp return" occurs at the ends of the horizontal moving path. For the weak patients or the elders (older than the age of 45), the meniscal cartilages and cruciate ligments of these users are quite possible to be injured during exercising.

(2) There is no the design of starting (warm up) and ending (slow down) sections (referring to FIG. 6). It violates the mechanotherapy. It also is easy to cause improper burden for the user's heart, especially for those who have weaker hearts. That is, it might influence the health and the safety of life of a user.

(3) Just only having pure horizontal exercise. The conventional apparatus only has the horizontal moving path. Thus, it only creates the horizontal exercise on the joints of lower limb and among the intervetebral discs. No vertical exercise is provided. Consequently, the overall smooth exercise is impossible. Therefore, the function for exercising the lower body's muscle and bones is significantly limited.

SUMMARY OF THE INVENTION

The primary object of the present invention is to provide a leg exercising equipment. It utilizes a rotary element, a link, a guiding element and a guiding frame to create a unique 8-shaped smooth reciprocated moving path.

An object of the present invention is to provide a leg exercising equipment. In which, it contains both the horizontal and vertical movements. The exercising effect is excellent.

Another object of the present invention is to provide a leg exercising equipment. It additional contains a starting section (warm up) and an ending section (slow down) so as to comply with the mechanotherapy.

DETAILED DESCRIPTION OF THE PREFERRED EMBODIMENT

Figure 1:
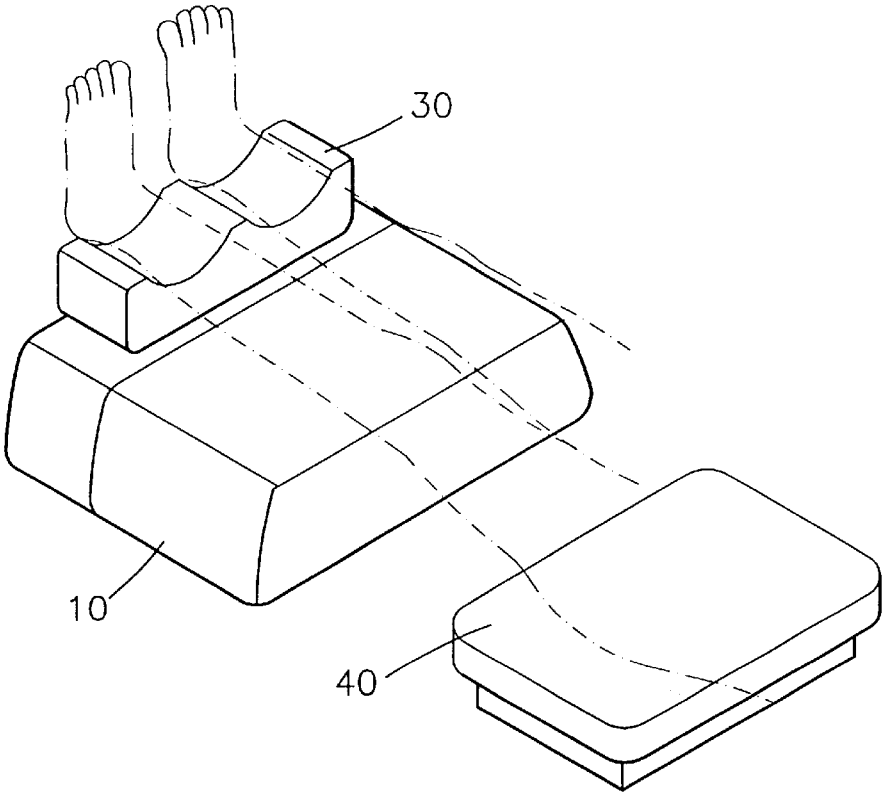
FIG. 1 is a perspective view of the present invention.
Figure 3:
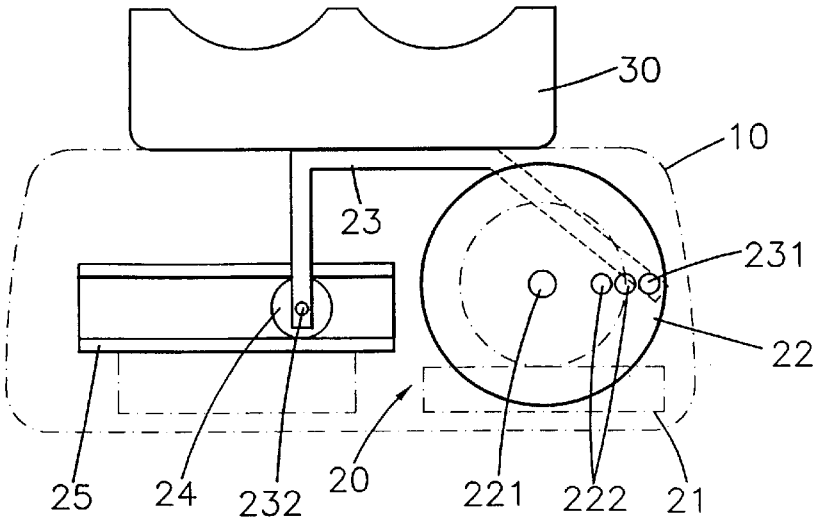
FIG. 3 is an exploded perspective view of a portion of this invention.
Figure 2:
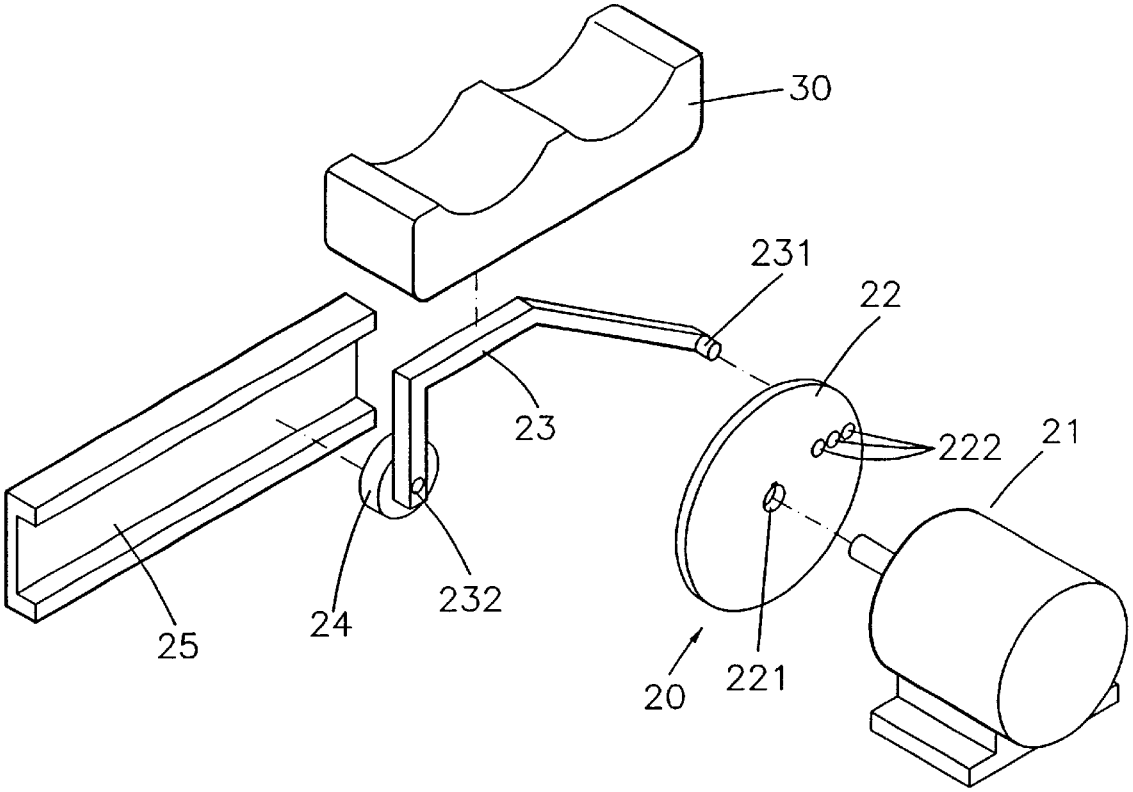
FIG. 2 is a cross-sectional view of the present invention.

Referring to FIGS. 1 to 6, the present invention is a leg exercising equipment. It mainly comprises a base 10, a driving system 20, and a lower leg supporting frame 30 for exercising the legs and lower body of a user.

The base 10 has an interior space 11.

The driving system 20 is disposed in the interior space 11 of the base 10. The driving system 20 includes a driving device 21, a rotary element 22, a link 23, a guiding element 24, and a guiding frame 25. More specifically, this driving device 21 drives the rotary element 22 rotating around a center 221 of the rotary element 22. The link 23 has a first end 231 and a second end 232. The first end 231 of the link 23 is pivoted on a predetermined position of the rotary element 22. The second end 232 of said link is pivoted or connected with the guiding element 24 (such as a roller or a sliding block). The guiding element 24 is limited by the guiding frame 25. So, the second end 232 of said link 23 is moved or swung back and forth.

The lower leg supporting frame 30 is mounted on the link 23. A pair of concave portions is provided for comfortably positioning the lower legs of the user.

Based on the above structure, when the rotary element 22 is driven by the driving device 21, the lower leg supporting frame 30 mounted on the link 23 will create a substantially 8-shaped smooth reciprocated moving path.

Furthermore, this rotary element 22 is preferably formed as a circular rotating disk. The guiding element 24 is a roller. The guiding frame 25 is disposed substantially horizontally. And, a height of the center 221 of the rotary element 22 is roughly equal to that of the guiding frame 25.

The rotary element 22 further has a micro-adjusting positioning portion 222 (such as a longitudinal slot or several holes) for changing a fixing position of the first end 231 of the link 23 so as to adjust the moving path of the lower leg supporting frame 30.

With regard to the detailed operation of this invention, it is described as follows.

Figure 4A:
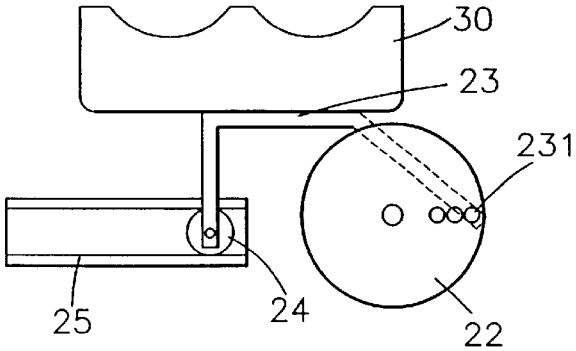
FIGS. 4A, 4B, 4C and 4D show the four conditions of the present invention while exercising.

First, referring to FIG. 4A, the first end 231 of the link 23 is approximately at the rightmost position of the rotary element 22. At this time, the lower leg supporting frame 30 is roughly horizontal.

Figure 4B:
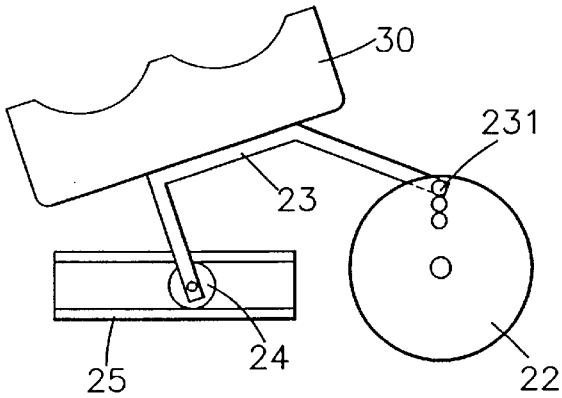

Second, referring to FIG. 4B, the first end 231 of the link 23 is moved to the highest position of the rotary element 22. At this time, because the guiding element 24 only can be horizontally moved along the guiding frame 25 (moving left), the lower leg supporting frame 30 will move up first and then move to the lower-left direction (like southwest).

Figure 4C:
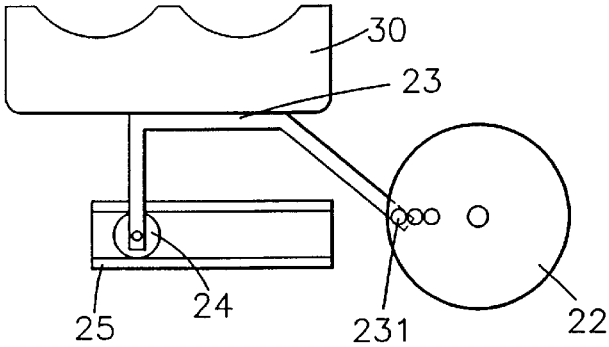

Next, referring to FIG. 4C, the first end 231 of the link 23 is approximately at the leftmost position of the rotary element 22. At this time, the lower leg supporting frame 30 is back to the roughly horizontal position.

Figure 4D:
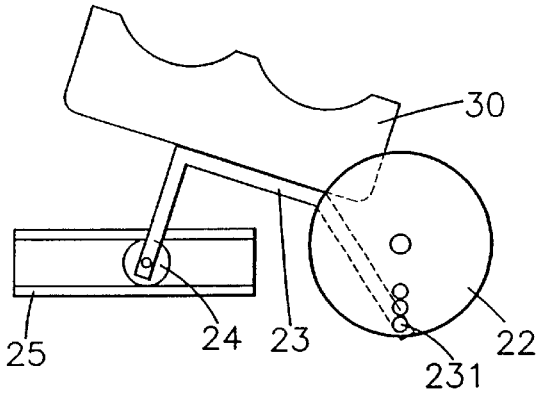

Finally, referring to FIG. 4D, the first end 231 of the link 23 is moved to the lowest position of the rotary element 22. At this time, because the guiding element 24 only can be horizontally moved along the guiding frame 25 (moving right), the lower leg supporting frame 30 will move up first and then move to the lower-right direction (like southeast).

Figure 5:
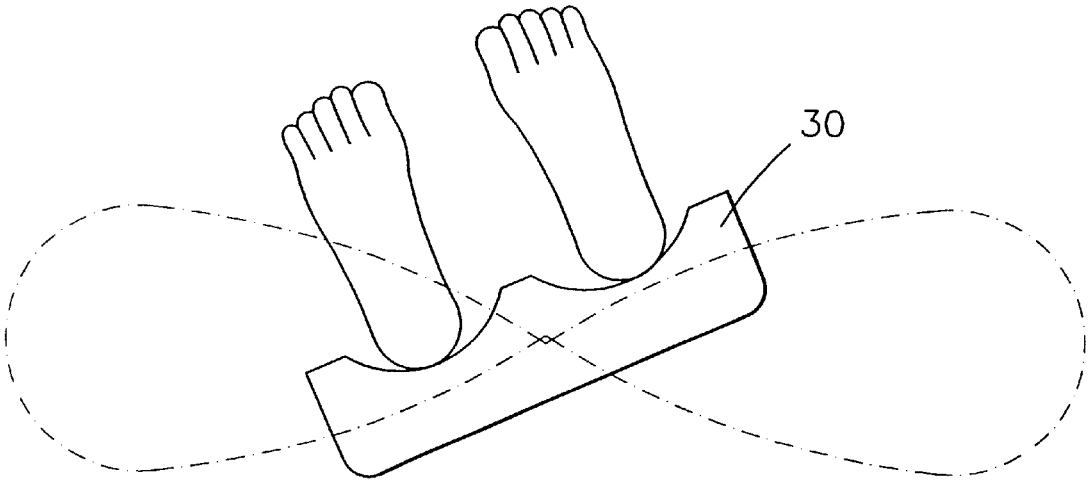
FIG. 5 shows the 8-shaped moving path of the present invention.

Thus, as shown in FIG. 5, a substantially 8-shaped smooth reciprocated moving path is created. It totally breaks the concept of the traditional pure-horizontal movement.

Figure 6:
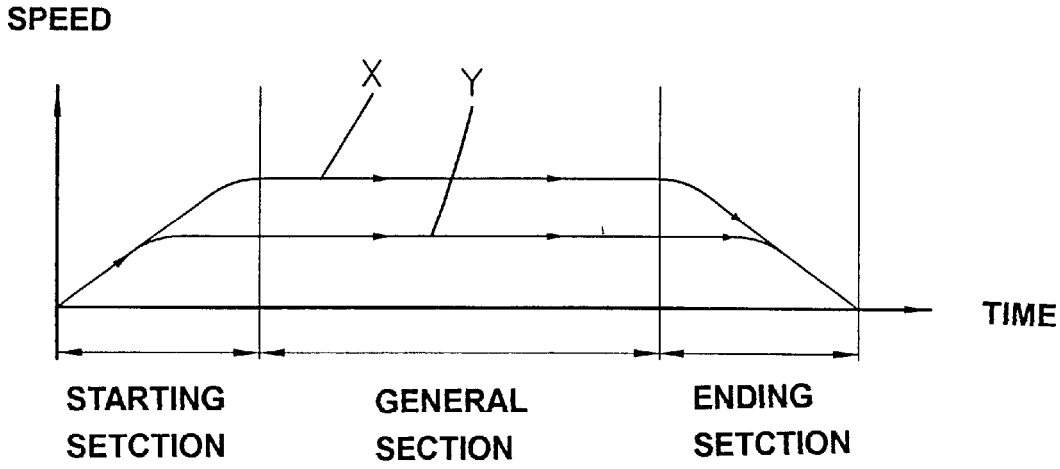
FIG. 6 is a diagram illustrating the curves of the exercising characteristics.
Figure 7:
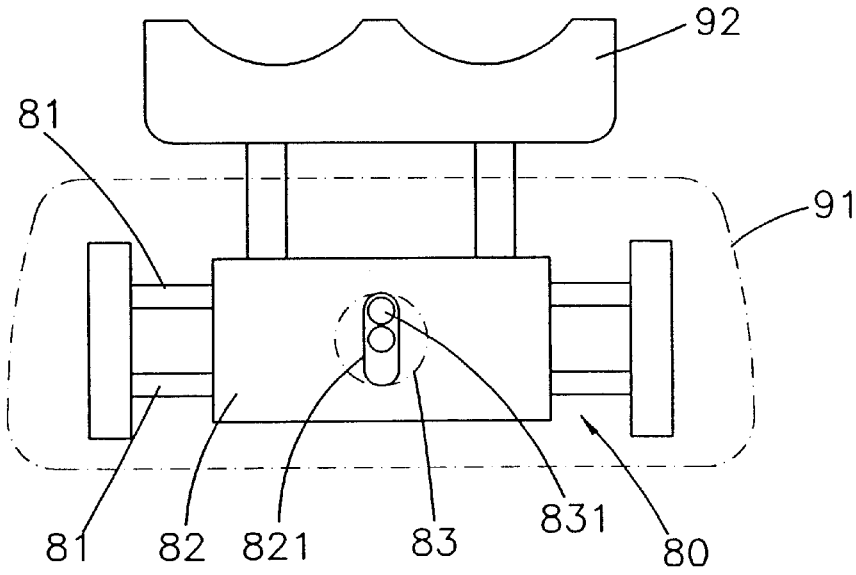
FIG. 7 (PRIOR ART)
FIG. 7 is a conventional horizontal swinging exercising apparatus.
Figure 8:
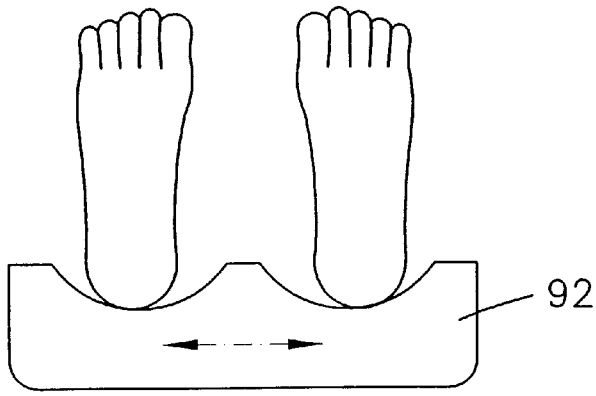
FIG. 8 (PRIOR ART)
FIG. 8 shows the moving path of the conventional horizontal swinging exercising apparatus.

Moreover, please see FIG. 6. In order to comply with the mechanotherapy, besides the conventional general section, a staring section (for gradually warm up) and an ending section (for gradually slow down) are added. In which, the general section will be rotated at a predetermined constant speed (X is a line for a normal user roughly operating at 120 RPM; Y is another line for a user having a weaker heart roughly operating at 80 RPM). Therefore, such starting section and ending section will prevent the disadvantage caused by suddenly increased or decreased load for the user's heart.

In addition, for a more perfect product, the leg exercising equipment can further comprise an auxiliary hip supporting seat 40 for auxiliary swinging a hip of the user. It includes a fixed board and a hip pad. Resilient blocks or springs (not shown) can be disposed between the fixed board and the hip pad. That is, when the user is laid down on it to enjoy this invention, these two legs are swinging at a special 8-shaped smooth reciprocated moving path, and the hip as well as the lower body of the user will be slightly moved accordingly. Thus, not only the user's legs are exercised, but also the muscle and bones of hip, waist, back and shoulder of the user are comfortably exercised.

In conclusion, the advantages and functions can be summarized as:

(1) Creating a unique 8-shaped smooth reciprocated moving path. It overcomes the disadvantage "sharp return" of the conventional horizontally moving apparatus. In this invention, the exercise's moving path is 8-shaped, smooth, comfortable, and effective.

(2) Containing both the horizontal and vertical movements. It improves the conventional one's only horizontal movement during exercising. This invention combines both the horizontal and vertical movements during exercising. So the exercising type for legs is various than before.

(3) Adding the starting section and the ending section. After the user turns on this invention, it will gradually increase its speed at this starting section and then will remain the preset speed at the general section. Similarly, when the user turns off, there is an ending section for gradually slowing down the speed and then it completely stops.

So, the load for the user's heart is gradually increased and decreased to comply with the mechanotherapy.

Figure 9:
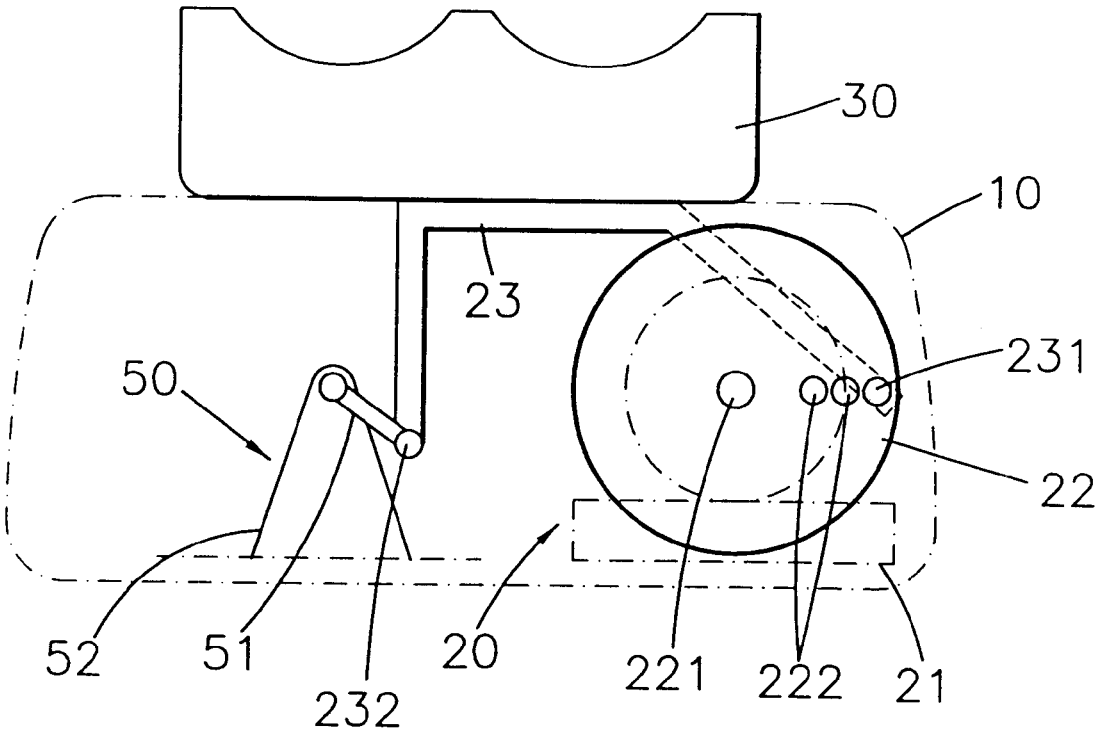
FIG. 9 shows another embodiment of the present invention.

Besides, referring to FIG. 9, another embodiment is disclosed. In this embodiment, the guiding element 51 is formed as a swingable short link, and the guiding frame 52 is fixed. One end of the guiding element 51 is pivoted on the guiding frame 52. The other end of the guiding element 51 is pivoted on the second end 232 of the link 23, so that the second end 232 of the link 23 is swung back and forth. Thus, a similar 8-shaped smooth reciprocated moving path still also can be achieved.

The above embodiments are only used to illustrate the present invention, not intended to limit the scope thereof. Many modifications of the above embodiments can be made without departing from the spirit of the present invention.

What is claimed is:

1. A lower leg exerciser comprising:

a hollow base;

a rotary disk received within said hollow base;

drive means for rotating said rotary disk about a central axis, said drive means being positioned within said hollow base;

a guide track mounted within said hollow base;

a slidable member slidably received and captured by said guide track;

a rigid linking member having a first end and a second end, said slidable member being pivotally mounted on said first end, said second end being pivotally affixed to said rotary disk;

a lower leg supporting frame fixedly secured to a central portion of said rigid linking member whereby rotation of said rotary disk about said central axis will cause said lower leg supporting frame to move along a substantially lemniscate-like path for exercising both of a user's lower legs, said lower legs being received by said lower leg supporting frame, said substantially lemniscate-like path providing a smooth and symmetrical closed path for reducing trauma to said user's lower legs.

2. The lower leg exerciser as recited in claim 1 wherein said rotary disk has a substantially circular peripheral contour.

3. The lower leg exerciser as recited in claim 1 wherein said slidable member forms a circular roller.

4. The lower leg exerciser as recited in claim 1 wherein said second end of said rigid linking member is adjustably pivoted to said rotary disk at one of a plurality of user-selective radii from said central axis.

5. The lower leg exerciser as recited in claim 1 wherein an auxiliary hip supporting seat is fixedly secured to said rigid linking member.

* * * * *